US006378718B1

(12) United States Patent
Maggi et al.

(10) Patent No.: US 6,378,718 B1
(45) Date of Patent: Apr. 30, 2002

(54) BEVERAGE CAN

(75) Inventors: Mario Maggi; Rosella Maggi, both of Calolziocorte-Lecco (IT)

(73) Assignee: Maggi S.p.A., Calolziocorte-Lecco (IT)

( * ) Notice: Subject to any disclaimer, the term of this patent is extended or adjusted under 35 U.S.C. 154(b) by 0 days.

(21) Appl. No.: 09/582,210

(22) PCT Filed: Jan. 21, 1999

(86) PCT No.: PCT/EP99/00418

§ 371 Date: Jul. 19, 2000

§ 102(e) Date: Jul. 19, 2000

(87) PCT Pub. No.: WO99/37546

PCT Pub. Date: Jul. 29, 1999

(30) Foreign Application Priority Data

Jan. 22, 1998 (IT) ..... M198A0107

(51) Int. Cl.[7] ..... B65D 51/18; B65D 51/24

(52) U.S. Cl. ..... 220/256; 220/254; 220/258; 220/259; 220/269; 220/270; 220/359.1; 220/837; 220/906; 220/212

(58) Field of Search ..... 220/256, 257, 220/258, 259, 254, 906, 253, 255, 265, 266, 269, 270, 837, 359.1, 359.3, 212

(56) References Cited

U.S. PATENT DOCUMENTS

| | | | | | |
|---|---|---|---|---|---|
| 3,204,805 | A | * | 9/1965 | May | 220/257 |
| 3,690,509 | A | * | 9/1972 | Kinoian et al. | 220/716 |
| 4,609,123 | A | * | 9/1986 | Poncy | 220/258 |
| 4,895,270 | A | * | 1/1990 | Main et al. | 220/257 |
| 4,917,258 | A | * | 4/1990 | Boyd et al. | 220/258 |
| 4,927,048 | A | * | 5/1990 | Howard | 220/257 |
| 5,139,163 | A | | 8/1992 | Diaz | |
| 5,647,497 | A | * | 7/1997 | Labbe | 220/257 |
| 5,934,495 | A | * | 8/1999 | Chiodo | 220/257 |
| 6,015,059 | A | * | 1/2000 | Takayama | 220/258 |

FOREIGN PATENT DOCUMENTS

| | | |
|---|---|---|
| FR | 2 701 008 | 8/1994 |
| WO | WO 93/02939 | 2/1993 |

* cited by examiner

*Primary Examiner*—Lee Young
*Assistant Examiner*—Niki M. Eloshway
(74) *Attorney, Agent, or Firm*—Oblon, Spivak, McClelland, Maier & Neustadt, P.C.

(57) ABSTRACT

A beverage can. In order to obtain distribution in hygienic conditions of fluid contained in the can a protection element is provided, which has a first and a second laminar portion which are superimposed and connected in a manner which is hermetically sealed but which is separable by being pivoted around a hinge. An upper surface of the first laminar portion of the protection element becomes a sterile support surface for an upper lip, and the lower surface of the second laminar portion of the protection element becomes a sterile support surface for a lower lip.

12 Claims, 2 Drawing Sheets

BEVERAGE CAN

BACKGROUND OF THE INVENTION

1. Field of the Invention

The subject of the present invention is an improved can to contain fluids, in particular drinks.

2. Discussion of the Background

Cans which are used mainly to contain drinks are known, which comprise a body to contain the fluid, which is provided with an upper surface formed by a first and a second portion. The first portion contains the second, which (in order to permit opening of the can), can be removed from the said first portion of upper surface, by raising a tab which is integral with the latter.

Cans of this type are particularly convenient, however they cause problems of an ecological nature, since when the tabs and the connected second portions are separated from the container and then thrown away, they are difficult to recycle at a low cost, because of their small size. Furthermore, since they are made of durable material, they remain in the environment for a long time without deteriorating, with obvious consequences of an ecological nature.

In order to eliminate the said disadvantages, a subsequent can has been created, in which the second portion of the upper surface is forced open when a tab is raised, which, when the can is closed, is constrained in a position which is substantially parallel to the said upper surface. When the container is open, both the tab and the second portion remain integral with the upper surface, thus preventing the aforementioned disadvantages.

In both cases the fluids (drinks), which are contained in both types of can concerned, are usually drunk directly, i.e. by using the can as If it were a glass. Unfortunately this very common practice does not guarantee the requisite hygiene, since, as is known, the can is handled and transported in an uncovered condition before it reaches the final consumer, who has difficulty in cleaning the can sufficiently carefully before the contents are consumed. In addition, any cleaning operation would be difficult, since it is impeded by the shape of the upper edge of the can, which in both types has a deep, narrow groove which is therefore difficult to clean, and acts as a receptacle for impurities, and which, when the contents are consumed, must be passed through by the fluid as it emerges from the can.

SUMMARY OF THE INVENTION

The object of the present invention is to provide an improved can to contain fluids, in particular drinks, which prevents the above-described disadvantages, i.e. which in all cases (i.e. whether the contents are consumed directly, or using a glass), permits distribution in hygienic conditions of the fluid contained in the can.

These objects are achieved by means of an improved can to contain fluids, in particular drinks, according to claim 1, to which reference is made for the sake of brevity.

The concept on which the invention is based is thus to seal to one another the surfaces which are destined to touch the lips of the final user, such that the said surfaces:

cannot be contaminated when the can is handled;

are separable simultaneously with opening of the can;

are hinged such that immediately before pouring takes place, one of the surfaces is pivoted so that both are disposed such as to form respective sterile support surfaces for both lips.

It is important to note that in the improved can according to the invention, since the first and the second laminar portions are hinged to one another, they continue to be connected to the empty can. Thus, the improvement according to the invention does not generate separate portions, which as already stated are difficult to recycle at a low cost, owing to their small size. Thus, another object of the invention is to provide a can which is hygienic, and which at the same time is environmentally friendly, since it limits to the maximum the impact on the environment.

The first and second laminar portions, which are hinged to one another at the edge of the upper surface of the can, have surfaces which can be written and/or printed on, with costs which are significantly lower than those which are necessary in order to write, or decorate, or carry out screen printing, on the surface of the container body and/or the upper and/or lower surface. Thus, a further object of the invention is to create a can in which the improvement permits a substantial increase in the advertising surface (and therefore of the advertising features) of the product, at costs which are significantly lower than those which are necessary in order to write, or decorate, or carry out screen printing, on the container body and/or the upper and/or lower surfaces of the can.

If the lower surface of the first laminar portion is constrained to the upper surface of the can by means of a glue, or similar means, which are sufficiently enduring to permit re-joining of the laminar portions after pouring has taken place, the improved can according to the invention can be re-closed. Thus, a further object of the invention is to provide an improved can which can be re-closed after each time it is opened.

As can be seen, the improvement according to the invention comprises substantially simply production of a punched section with reduced dimensions, whereas the can for which the said punched section is designed remains altogether identical to the conventional can. This means that the invention can be put into effect without altering the original structure of the can, which is completely conventional. The invention can thus be implemented at particularly low costs, since it is not necessary to modify the structural technology of the can. Thus, a further object of the invention is also to obtain simultaneously all the objects previously described, in a particularly economical manner.

BRIEF DESCRIPTION OF THE DRAWINGS

The invention is illustrated purely by way of non-limiting example by means of the attached drawing plates, which show one of the possible embodiments (the preferred embodiment) of the invention.

DESCRIPTION OF THE PREFERRED EMBODIMENTS

Figure 1:
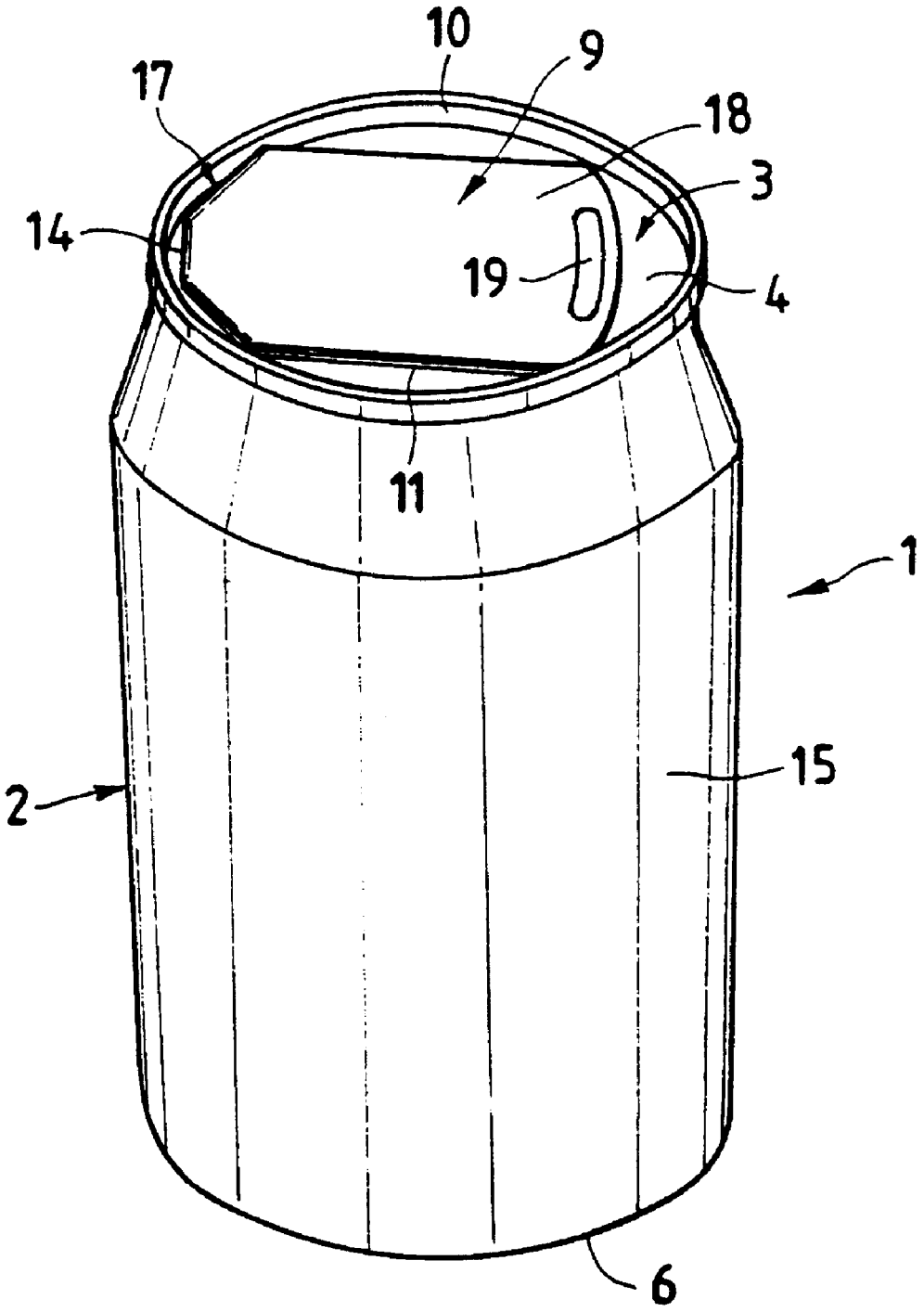
FIG. 1 is a partial perspective view of an improved can according to the invention in a closed configuration.
Figure 2:
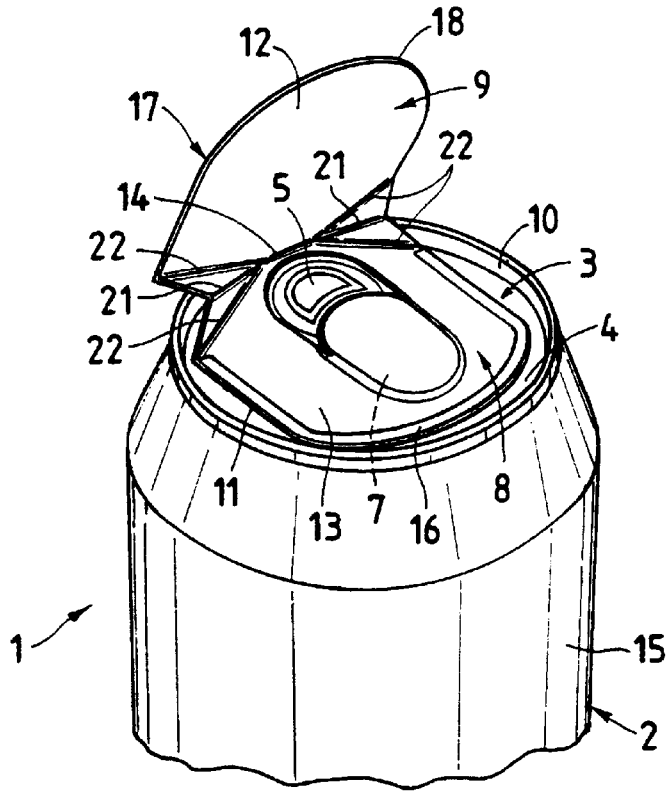
FIG. 2 is a further perspective view of the improved can according to the invention in the opening step.
Figure 3:
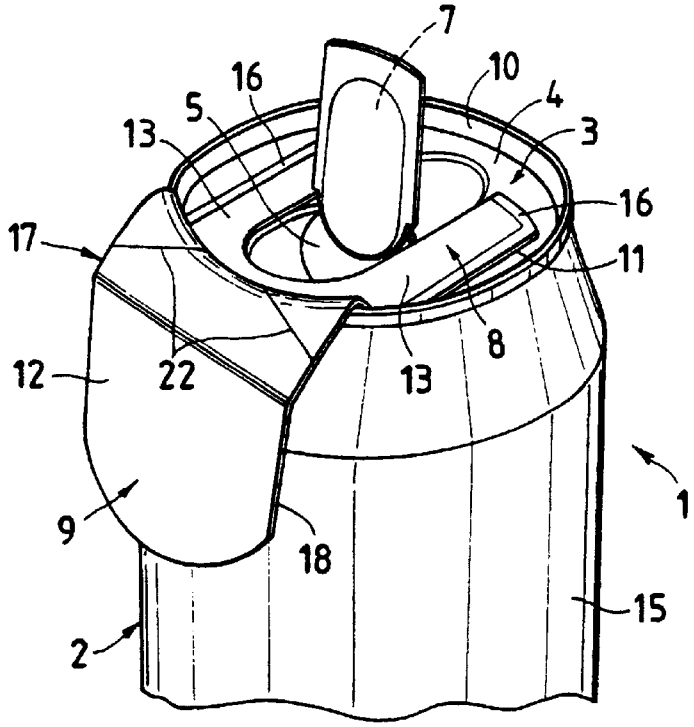
FIG. 3 is a further perspective view of the improved can according to the invention in an open configuration.

With reference to the aforementioned figures, the improved can to contain fluids, in particular drinks, according to the invention, which is generally indicated 1, comprises a body 2 to contain the fluid, which is provided with a lateral wall 15, an upper wall 3, and a base wall 6. The upper wall 3 consists of a first 4 and a second 5 portion.

The first portion 4 contains the second portion 5. In the example given, the second portion 5 is connected to the first laminar portion 4 by means of a pre-determined fracture line, which is set out such that the second portion 5 can be forced open towards the interior of the body 2, relative to the said first portion 4 of upper wall 3. By this means, when the can is open, the said second laminar portion 5 remains integral with the upper wall 3, and thus with the can. Forcing open of the second laminar portion 5 (i.e. opening of the can 1) is obtained by raising a tab 7, which, when the can 1 is closed, is constrained in a position which is substantially parallel to the said upper wall 3.

According to the invention, the improvement thus comprises a protection element 17, which consists of a first 8 and a second 9 laminar portion, which are constrained to one another by means of a hinge 14 which is disposed on the edge 10 of the upper wall 3 of the can 1. The lower surface 11 of the first laminar portion 8 of the protection element 17 is superimposed on, and adheres to, the outer surface of the upper wall 3 of the can, such as to protect the upper wall against impurities. The lower surface 12 of the second laminar portion 9 of the protection element 17 is superimposed on, and adheres to, the-upper surface 13 of the said first laminar portion 8 of the protection element 17, with the possibility of separation from the latter, such that the said surfaces 12, 13 protect one another against impurities. When the can 1 is opened, the second laminar portion 9 of the protection element 17 can be separated from the first portion 8 by being pivoted around the hinge 14, and can be positioned on the lateral wall 15 of the can 1, such that the upper surface 13 of the first laminar portion 8 of the protection element 17 becomes the sterile support surface for the upper lip, and the lower surface 12 of the second laminar portion 9 of the protection element 17 becomes the sterile support surface for the lower lip.

Again according to the invention, the protection element 17 can however also be applied to cans in which, in order to obtain opening, the second laminar portion 5 is totally separable from the first laminar portion 4, by acting on a tab. For the sake of brevity, this embodiment of the invention has not been illustrated.

Preferably, the first laminar portion 8 of the protection element 17 does not cover the second laminar portion 5 of the upper wall 3, which however is covered by the second laminar portion 9 of the protection element 17. By this means, the presence of the protection element 17 does not affect the force required in order to open the can, and the aperture which is formed in the upper wall 3 when rupture has taken place, has the same characteristics (for example shape of the edge) as on conventional cans, since it is not conditioned by the protection element 17. If required, the first laminar portion 8 of the protection element 17 can be limited to the extent that it constitutes only a means for constraining the second laminar portion 9 to the can. This particular embodiment of the invention has also not been illustrated, for the sake of brevity. The first laminar portion 8 adheres to the second laminar portion 9 by means of an interposed first layer of adhesive material 16. The layer of adhesive material should be understood in the broadest sense, and is thus not necessarily formed by glue alone, since it can also be obtained by means of continuous or spot welding, or other equivalent means. Preferably, the interposed first layer of adhesive material 16 is glue of the type which permits several operations of detachment and re-attachment of the laminar portions 8, 9. By this means, the protection element 17 can also act as an element for re-closing the can after the first time it has been opened. In order to assist the hermetic re-closing without using excessive glue, and preventing the glue from being able to come into direct contact with the lips, the interposed first layer of adhesive material 16 is preferably disposed only at the edges. Tests have made it possible to determine that when the interposed first layer of adhesive material 16 is disposed on the first laminar portion 8, the glue is unlikely to come into contact with (and therefore adhere to) the face of the person who is drinking, even if this person has a beard and moustache. In order to permit a very stable position (if necessary) of the second laminar portion 9 against the lateral wall 15 of the can 1, the upper surface 18 of the second laminar portion 9 of the protection element 17 is provided with a second layer of adhesive material 19, which allows this laminar portion to be constrained to the lateral wall 15 of the can 1. The protection element 17 can be made of various materials, since there are various materials which are simultaneously impermeable, resistant to weather conditions (water and sun), which can be glued, printed on, cut by means of a punch, and which have a relatively low cost. Some examples can consist of resilient materials, or plasticised paper or plastics.

During production of the can, the protection element 17 is applied to the upper sterile wall 3. This application, which improves the can according to the invention, and is preferably carried out by means of an additional, third layer of glue, not shown, has the considerable advantage that it achieves the above-described objects, without involving modification of any step of production or filling of the can, thus providing considerable financial advantages, since, as is known, simply changing the screen printing of the can can involve a substantial amount of work. For the same reason, the can itself is an advertising vehicle with limited potential. Application of the protection element 17 makes the can competitive (from this point of view also, in addition to the point of view of hygiene), compared with other containers. In order to open the can, the user can proceed, as has always been the case, by acting on the tab 7. Simultaneously, the first laminar portion 8 is separated from the second laminar portion 9. The latter is then folded onto the lateral wall of the can 1, to which it adheres by means of the second layer of adhesive material 19. During this folding, a folding dead point is passed, consisting of initial resistance to separation by pivoting around the hinge 14, of the first laminar portion 8 relative to the second laminar portion 9, and subsequent spontaneous motion of separation of the said portions 8 and 9. This phenomenon, which is defined as the "dead point", is preferably obtained by means of the two particular folds of the element 17 which are illustrated in the figures. Each of the said folds comprises a second folding line 21, which continues the folding line of the hinge 14, and two third folding lines 22, which converge on that of the hinge 14, according to acute equal angles. Other folds which do or do not give rise to the same phenomenon of the "dead point" are possible, but for the sake of brevity they have not been illustrated.

When it is being distributed, the fluid which emerges from the can no longer runs in the edge of the tin before it is drunk or poured, but optionally only on the sterile surface of the protection element 17, thus guaranteeing the necessary hygiene. If distribution of the fluid has not been completed, the can can be re-closed, by superimposing the second laminar portion 9 on the first 8. By this means, potential contamination of the fluid which remains in the can can be avoided.

The improved can according to the invention can be used not only in order to drink drinks directly, but also guarantees the same hygiene if the drink is drunk after being poured into a glass.

The improved can according to the invention can also be used for any other fluid which needs to be protected against contamination whilst it is being poured. For example, the improved can according to the invention could be used to preserve engineering fluids (fluids for sealed circuits for cooling systems, fluids for lubrication circuits, fluids for brake systems and the like), or to contain medicinal or other substances.

What is claimed is:

1. A can configured to contain a fluid, said can comprising:

a body configured to contain the fluid, said body including:

a lateral wall, an upper wall having an edge connected to an upper portion of said lateral wall, said upper wall formed from first and second portions, wherein an outer boundary of said second portion of said upper wall is located within said outer boundary of said first portion of said upper wall, and a base wall connected to a lower portion of said lateral wall;

a tab configured so as to be raised to be approximately perpendicular to said upper wall in order to bend said second portion of said upper wall into an interior of said body relative to said first portion of said upper wall to create an opening in said upper wall of said can such that when said can is closed, said tab is constrained in a position which is substantially parallel to said upper wall, wherein said tab includes:

a protection element including first and second laminar portions, a hinge configured to constrain said first laminar port ion of said protection element with respect to said second laminar portion of said protection element, said hinge being disposed near said edge of said upper wall of said can, wherein a lower surface of said first laminar portion of said protection element is superimposed on and adheres to, via a first layer of adhesive material, an outer surface of said upper wall of said can even after said opening has been formed in said upper wall of said can, said first laminar portion of said protection element thereby protecting said upper wall of said can against any impurities when said can is opened, and said second laminar portion of said protection element being movable away from said first laminar portion of said protection element by being pivoted around said hinge, said second laminar portion of said protection element remaining attached to said first laminar portion of said protection element at said hinge, and said first laminar portion of said protection element being positionable on said lateral wall of said can, such that an upper surface of said first laminar portion of said protection element becomes a first sterile support surface for an upper lip of a person who will drink from said can, and a lower surface of said second laminar portion of said protection element becomes a second sterile support surface for a lower lip of the person who will drink from said can.

2. The can according to claim 1, wherein said second portion of said upper wall is bent to be approximately parallel to said lateral wall to form said opening when said tab is raised so as to be approximately perpendicular to said upper wall, and when said can is closed, said second laminar portion of said protection element is constrained in a position substantially parallel to said upper wall of said can, such that when said can is open, both said tab and said second portion of said upper wall of said can remain integral with said upper wall of said can.

3. The can according to claim 1, wherein said first laminar portion of said protection element does not cover said second portion of said upper wall, said second portion of said upper wall of said can being covered by said second laminar portion of said protection element.

4. The can according to claim 1, wherein said first laminar portion adheres to said second laminar portion via an first layer of adhesive material interposed between said first and second laminar portions, said first layer of adhesive material being of a type which permits several operations of detachment and re-attachment of said first and second laminar portions.

5. The can according to claim 4, wherein said first layer of adhesive material is disposed at edges of said first and second laminar portions.

6. The can according to claim 5, wherein said first layer of adhesive material is disposed on said first laminar portion of said protection element.

7. The can according to claim 4, wherein said first layer of adhesive material is disposed on said first laminar portion.

8. The can according to claim 1, wherein an upper surface of said second laminar portion of said protective element is provided with a second layer of adhesive material, said second layer of adhesive material allowing said second laminar portion to be constrained to said lateral wall of said can.

9. The can according to claim 1, wherein said protection element is a punched section made of flexible material which is impermeable, and can be printed and/or written on.

10. The can according to claim 1, wherein said first laminar portion is folded relative to said second laminar portion along a first folding line to form a dead folding point, said dead folding point having an initial resistance to separation due to being pivoted around said hinge between said first and second laminar portions, and subsequent spontaneous motion of separation of said first and second laminar portions.

11. The can according to claim 10, wherein said hinge includes two opposite folds, each of said two opposite folds having a second folding line, said second folding lines of each of said two opposite folds being a continuation of said first folding line of said hinge, said hinge further comprising first and second third folding lines, said first and second third folding lines converging on said first folding line of said hinge at first and second angles, respectively, wherein said first and second angles are both acute and are equal to each other.

12. The can according to claim 1, wherein said first laminar portions of said protection element is limited in that said first laminar portion of said protection element constitutes only a means for constraining said second laminar portion to said can.

* * * * *

UNITED STATES PATENT AND TRADEMARK OFFICE

CERTIFICATE OF CORRECTION

PATENT NO. : 6,378,718 B1
DATED : April 30, 2002
INVENTOR(S) : Maggi et al.

It is certified that error appears in the above-identified patent and that said Letters Patent is hereby corrected as shown below:

Title page,
Item [30], the Foreign Application Priority Data is incorrect. Item [30] should read as follows:
-- [30] Foreign Application Priority Data
Jan. 22, 1998 (IT) ---------- MI98A000107 --

Signed and Sealed this

Twenty-fourth Day of September, 2002

*Attest:*

*Attesting Officer*

JAMES E. ROGAN
*Director of the United States Patent and Trademark Office*